US012569724B1

(12) United States Patent
Cannella

(10) Patent No.: US 12,569,724 B1
(45) Date of Patent: Mar. 10, 2026

(54) PADDLE-MOUNTED HOOK APPARATUS FOR RETRIEVING PICKLEBALLS

(71) Applicant: Salvatore Cannella, Surprise, AZ (US)

(72) Inventor: Salvatore Cannella, Surprise, AZ (US)

( * ) Notice: Subject to any disclaimer, the term of this patent is extended or adjusted under 35 U.S.C. 154(b) by 0 days.

(21) Appl. No.: 19/281,661

(22) Filed: Jul. 27, 2025

(51) Int. Cl.

| | |
|---|---|
| ***A63B 47/02*** | (2006.01) |
| ***A63B 59/42*** | (2015.01) |
| ***A63B 60/14*** | (2015.01) |
| ***A63B 102/04*** | (2015.01) |
| ***A63B 102/08*** | (2015.01) |
| ***A63B 102/30*** | (2015.01) |

(52) U.S. Cl.
CPC ..... *A63B 47/02* (2013.01); *A63B 60/14* (2015.10); *A63B 59/42* (2015.10); *A63B 2102/04* (2015.10); *A63B 2102/08* (2015.10); *A63B 2102/30* (2015.10); *A63B 2209/10* (2013.01)

(58) Field of Classification Search
CPC ..... A63B 47/02; A63B 60/14; A63B 59/42; A63B 2102/04; A63B 2102/08; A63B 2102/30; A63B 2209/10
See application file for complete search history.

(56) References Cited

U.S. PATENT DOCUMENTS

| | | | | |
|---|---|---|---|---|
| 3,773,374 A * | 11/1973 | D'Luhy | ..... | A63B 47/02 294/19.2 |
| 4,254,981 A * | 3/1981 | Wilson | ..... | A63B 47/02 294/19.2 |
| 6,454,331 B1 * | 9/2002 | Ahlenius | ..... | A63B 47/02 294/19.2 |
| 2007/0219014 A1 * | 9/2007 | Merriman | ..... | A63B 47/02 473/286 |

FOREIGN PATENT DOCUMENTS

| | | | | |
|---|---|---|---|---|
| CA | 2281308 A1 * | 3/2001 | ..... | A63B 47/02 |
| CN | 205108951 U * | 3/2016 | | |

OTHER PUBLICATIONS

CN-205108951-U Translated Document. (Year: 2016).*

* cited by examiner

*Primary Examiner* — Jeffrey S Vanderveen
(74) *Attorney, Agent, or Firm* — Michael D. Eisenberg; MDE Patents

(57) ABSTRACT

A retrieval apparatus attaches to the handle of a paddle, thereby enabling the user to retrieve pickleballs, with minimal bending. The apparatus comprises a hook and a base. The base has a first half and a second half. The hook has a stem in an L-shape when the apparatus is mounted on the paddle and the paddle is held upright, a curved body, and an end-point. The end-point is angled at least 30 degrees relative to the horizontal plane of the stem. The second half of the base includes various attachment mechanisms for securing the apparatus to a paddle handle, which include: an affixed channel with a snapping mechanism, a breathable slit, an adhesive, or a form-fitting sleeve.

15 Claims, 9 Drawing Sheets

PADDLE-MOUNTED HOOK APPARATUS FOR RETRIEVING PICKLEBALLS

FIELD OF INVENTION

The present invention relates generally to an apparatus for used in paddle-based sports (e.g., pickleball); and more particularly to a hook-based retrieval apparatus that can be mounted to the handle of a paddle or similar sporting equipment for use in retrieving items, such as pickleballs or objects with perforations akin to pickleballs.

BACKGROUND OF INVENTION

Participants in paddle-based sports frequently need to retrieve objects such as pickleballs or shuttlecocks from the ground. This repetitive task often requires extensive bending or kneeling, which can be inconvenient or strenuous, particularly for individuals with limited mobility. Current retrieval tools are either separate from the paddle; overly bulky (e.g., suction cup retrieval mechanism which makes the handle of the paddle wider and lessen the grip); or not sufficiently ergonomic or versatile.

What is needed is a compact (i.e., a non-bulky) pickleball retrieval apparatus that attaches to the handle of the paddle, which enables convenient and hygienic retrieval of the pickleball, without impacting the grip or balance of the paddle.

SUMMARY OF THE INVENTION

The present invention provides a retrieval apparatus that attaches to the handle of a paddle, enabling the user to retrieve sports items, such as pickleballs or shuttlecocks with minimal or substantially reduced bending. The apparatus comprises a hook and a base with a hollow or filled interior. The base has a first half and a second half, with the first half operatively connected to the hook and the second half operatively connected to the paddle handle. The hook features a stem in an L-shape when the apparatus is mounted on the paddle and the paddle is held upright, a curved body, and an end-point. The end-point is angled at least 30 degrees relative to the horizontal plane of the stem. The second half of the base includes various attachment mechanisms for securing the apparatus to a paddle handle. These include: an affixed channel with a snapping mechanism, a breathable slit, an adhesive, or a form-fitting sleeve. This configuration offers multiple mounting options depending on user preference and paddle geometry.

In a variant, an apparatus retrieves items. The apparatus comprises: a hook; a base with a hollow interior or filled interior, wherein the base comprises: a first half and a second half, wherein the first half is operatively connected to the hook, and wherein the second half is operatively connected to a handle of a paddle; wherein the hook comprises: a stem; a curved body; and an end-point; wherein the stem that has an L-shape when the body is attached to the handle of the paddle and the paddle is held in a fully upright position; and wherein the curved body is operatively connected to the stem and the end-point, wherein the end-point is operatively connected to the stem such that there is at least 30 degrees of separation between a horizontal plane of the stem and a plane of the end point; wherein the second half comprises: an affixed channel spanning a partial section within the second half, wherein the affixed channel is configured to connect the body to the handle, via a snapping mechanism; a breathable slit spanning an entire section across the second half, wherein the breathable slit is configured to connect the body to the handle; an adhesive attached to a top surface of the base, wherein the adhesive is configured to connect the body to the handle via an adhesive mechanism; or a sleeve fitting over the handle, wherein the sleeve is configured to connect the body to the handle.

In a variant, the item is a pickle ball, wiffle ball, floorball ball, or a badminton shuttlecock.

In a variant, the base is shaped as a sphere, cube, rectangular prism, or cylinder.

In a variant, the first half and the second half are equal in area when the adhesive is attached to the top surface of the base.

In a variant, the first half has a greater area than the second half when the affixed channel spanning the partial section within the bottom half and the breathable slit spanning the entire section across the bottom half.

In a variant, the affixed channel has diameter wider than the handle.

In a variant, the affixed channel comprises walls and ledges, wherein the ledges protrude out from the walls.

In the variant, the ledges actuate the snapping mechanism when the ledge contacts the handle of the paddle.

In a variant, the base is composed of rubber or cork when the base is the filled interior.

In a variant, the stem does not dangle when the base is held in the fully upright position.

In a variant, the stem has two sections attached perpendicularly to each other to make the L-shape, wherein a first section of the two sections is surrounded by a canister that is wider in diameter than a second section of the two sections.

In a variant, the first section of the stem is attached to the base.

In a variant, the second section of the stem is attached to the curved body.

In a variant, a method for retrieving a pickleball comprises: appending an apparatus to a handle of the pickleball, wherein the apparatus comprises: a hook; a base with a hollow interior or filled interior, wherein the base comprises: a first half and a second half, wherein the first half is operatively connected to the hook, and wherein the second half is operatively connected to the handle of the paddle; wherein the hook comprises: a stem; a curved body; and an end-point; wherein the stem that has an L-shape when the body is attached to the handle of the paddle and the paddle is held in a fully upright position, wherein the L-shape has two sections perpendicularly connected to each other, wherein a first section of the two sections is surrounded by a canister that is wider in diameter than a second section of the two sections and wherein the curved body is operatively connected to the stem and the end-point, wherein the end-point is operatively connected to the stem such that there is 45 degrees of separation between a horizontal plane of the stem and a plane of the end point; wherein the second half comprises an adhesive attached to a top surface of the base, wherein the adhesive is configured to connect the body to the handle via an adhesive mechanism.

In a variant, a paddle comprises: a handle operatively connected a face, wherein the face comprises an edge guard; an apparatus configured for attachment and detachment to the handle; and a cannister configured to surround the apparatus, wherein the apparatus comprises: a hook configured to retrieve a pickleball; and a base with a hollow interior or filled interior, wherein the base comprises: a first half and a second half; wherein the first half and the second half are equal in area; wherein the first half is operatively connected to the hook, wherein the second half is operatively connected to the handle of the paddle; wherein the hook comprises: a stem, a curved body, and an end-point; wherein the stem that has an L-shape when the body is attached to the handle of the paddle and the paddle is held in a fully upright position, wherein the L-shape of the stem has two sections perpendicularly connected to each other, wherein a first section of the two sections is surrounded by a canister that is wider in diameter than a second section of the two sections, wherein the curved body is operatively connected to the stem and the end-point, wherein the end-point is operatively connected to the stem such that there is 45 degrees of separation between a horizontal plane of the stem and a plane of the end point; wherein the second half comprises an adhesive attached to a top surface of the base, wherein the adhesive is configured to connect the body to the handle via an adhesive mechanism; wherein the first section of the L-shape of the stem is attached to the base; wherein the second section of the L-shape of the stem is attached to the curved body.

DETAILED DESCRIPTION OF THE INVENTION

The systems and methods herein are directed to sporting equipment for paddle-based sports and items with a perforated pattern. More particularly, an apparatus can be attached and removable (i.e., a permanent connection is not achieved) to a handle of a pickleball paddle, table tennis, or the like; and retrieval of items with perforation, such as a pickleball, shuttlecock, and wiffle ball, via a hook that curves like a fish hook or scythe.

In the systems and methods herein, the apparatus comprises a base operatively connected to a hook, wherein: the base has a first half (1A, 1B, 1C, or 1D) and a second half (2A, 2B, 2C, or 2D); and the hook comprises a L-shaped stem (3A, 3B, 3C, or 3D) operatively connected to a curved body (4A, 4B, 4C, or 4D). The curved body can be operatively connected to an end-point (5A, 5B, 5C, or 5D). The L-shaped stem (3A, 3B, 3C, or 3D) operatively connected to the curved body (4A, 4B, 4C, or 4D) operatively connected to the end-point (5A, 5B, 5C, or 5D) can each be composed of plastic, metal, rubber, cork, or any other material. More particularly, the L-shaped stem (3A, 3B, 3C, or 3D), the curved body (4A, 4B, 4C, or 4D), and the end-point (5A, 5B, 5C, or 5D) can operatively connect to each other, such that the curved body (4A, 4B, 4C, or 4D) is in between the L-shaped stem (3A, 3B, 3C, or 3D) and the end-point (5A, 5B, 5C, or 5D).

In the system and methods herein, the L-shaped stem has a vertical section (v) perpendicular to the horizontal section (h). The vertical section (v) can: (i) partially fit into the first half of the base and partially extends from the first half the base, or (ii) be appended to the first half of the space via a fastener mechanism, adhesive mechanism, or piercing mechanism (e.g., a sharp section of the vertical section (v) lodged into the first half of the base). The horizontal section can operatively connect to the curved body operatively connected to the end-point (5A, 5B, 5C, or 5D), wherein the end-point is rounded (see FIG. 1-FIG. 5 and FIG. 8-FIG. 10). While not depicted, the end-point can be: square-shaped; spherically-shaped; block-shaped (e.g., a cube or quadrilateral prism); or a n-prong grappling hook (where n=1, 2, 3, or 4). A canister (10), which has a larger diameter than the diameter of the base, can be fitted entirely around the base (1A and 2A; 1B and 2B; 3A and 3B; or 4A and 4B), while: covering a substantial portion (i.e., 40-100%) of the vertical section (v) extending from the second half (2A, 2B, 2C, or 2D) and contacting the handle of the paddle (see FIG. 10).

Figure 7:
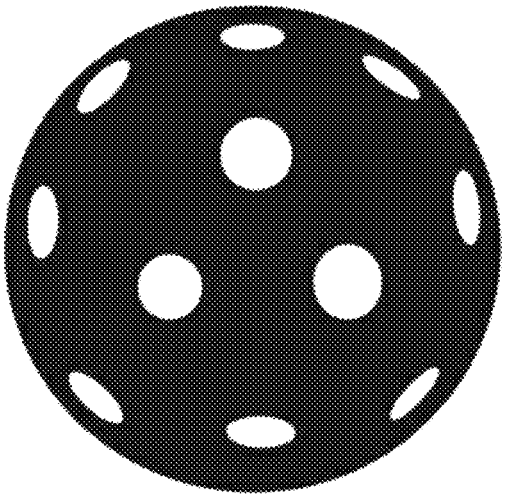
FIG. 7 is a depiction of an item that is retrieved by the apparatus.
Figure 8:
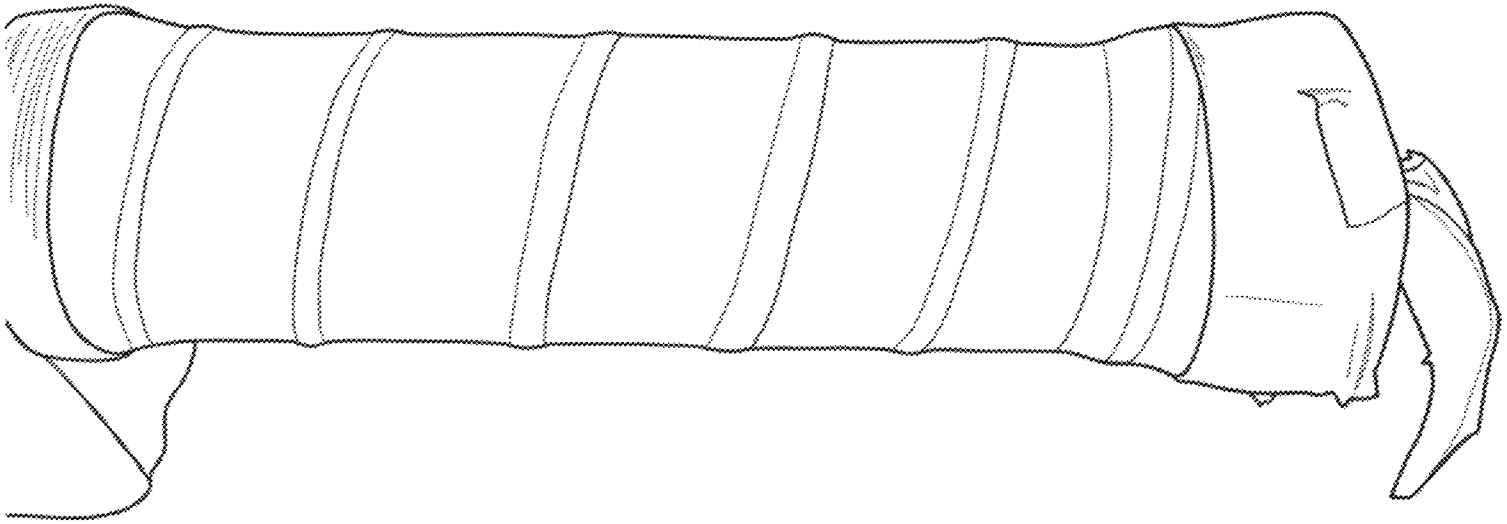
FIG. 8 is a depiction of the hook without a retrieved pickleball.
Figure 9:
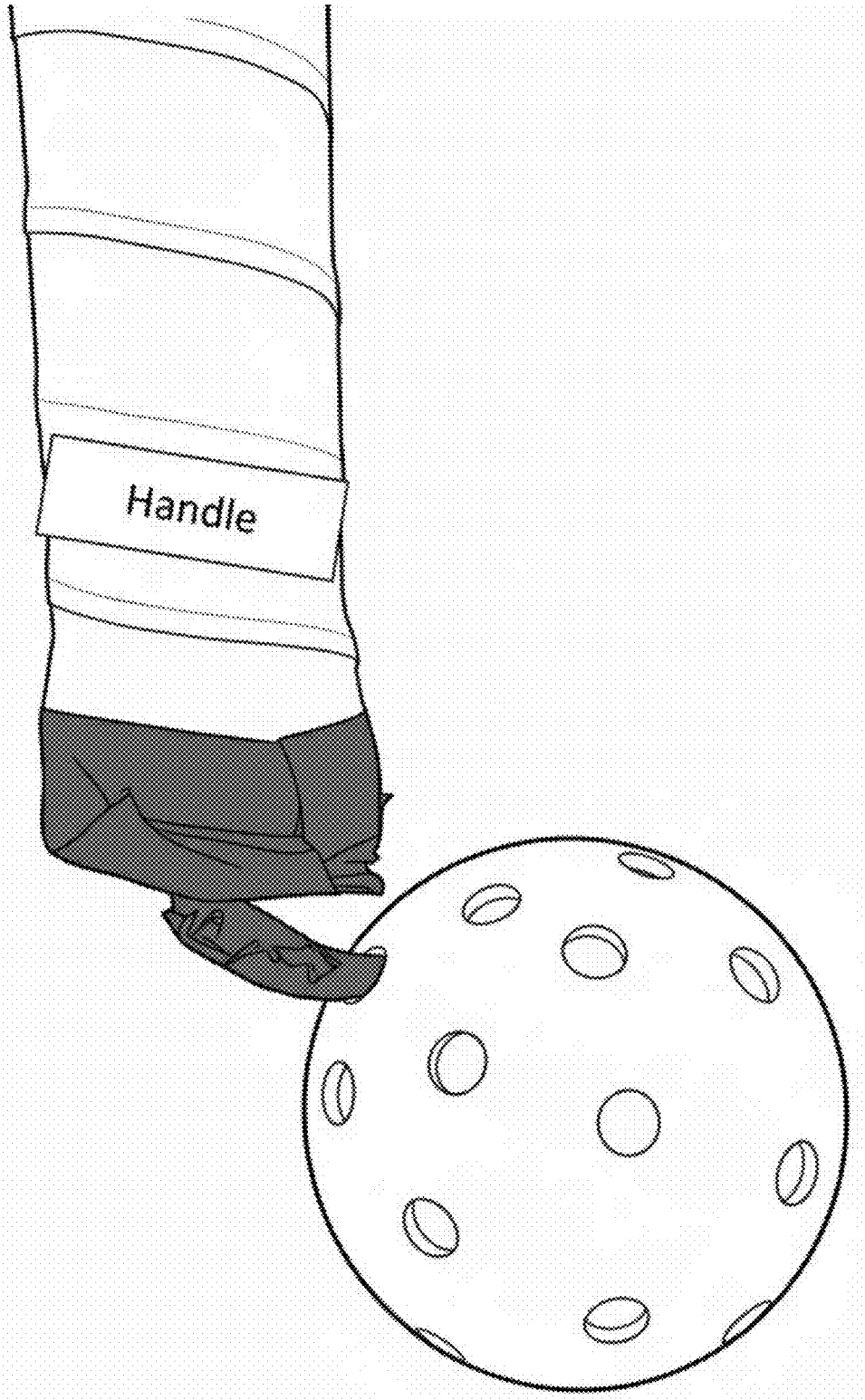
FIG. 9 is a depiction of the hook with a retrieved pickleball.
Figure 10:
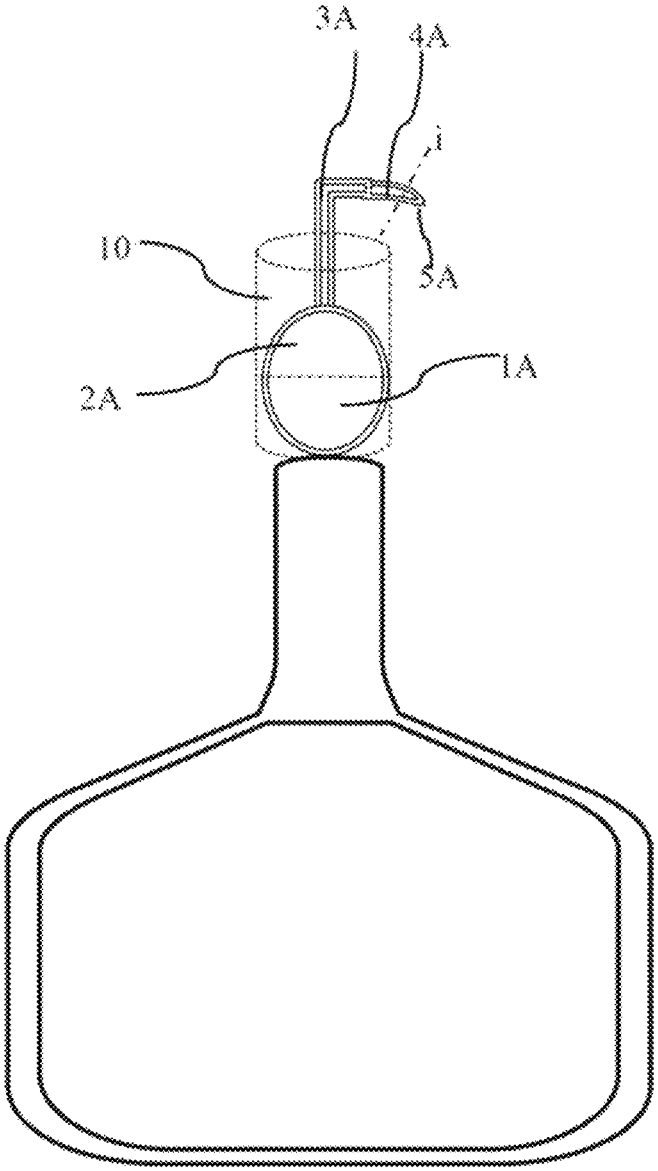
FIG. 10 is a depiction of the apparatus (base and hook) with a canister covering the apparatus.

In the system and methods herein, the horizontal section (h) of the stem (3A, 3B, 3C, or 3D), the curved body (4A, 4B, 4C, or 4D); and the end-point (5A, 5B, 5C, or 5D) make a hook akin to a fish hook or scythe (see FIG. 8) that enters into a perforation of an item with perforations, such as a pickle ball (see FIG. 7), thereby actuating retrieval of said pickleball (see FIG. 9).

Figure 6:
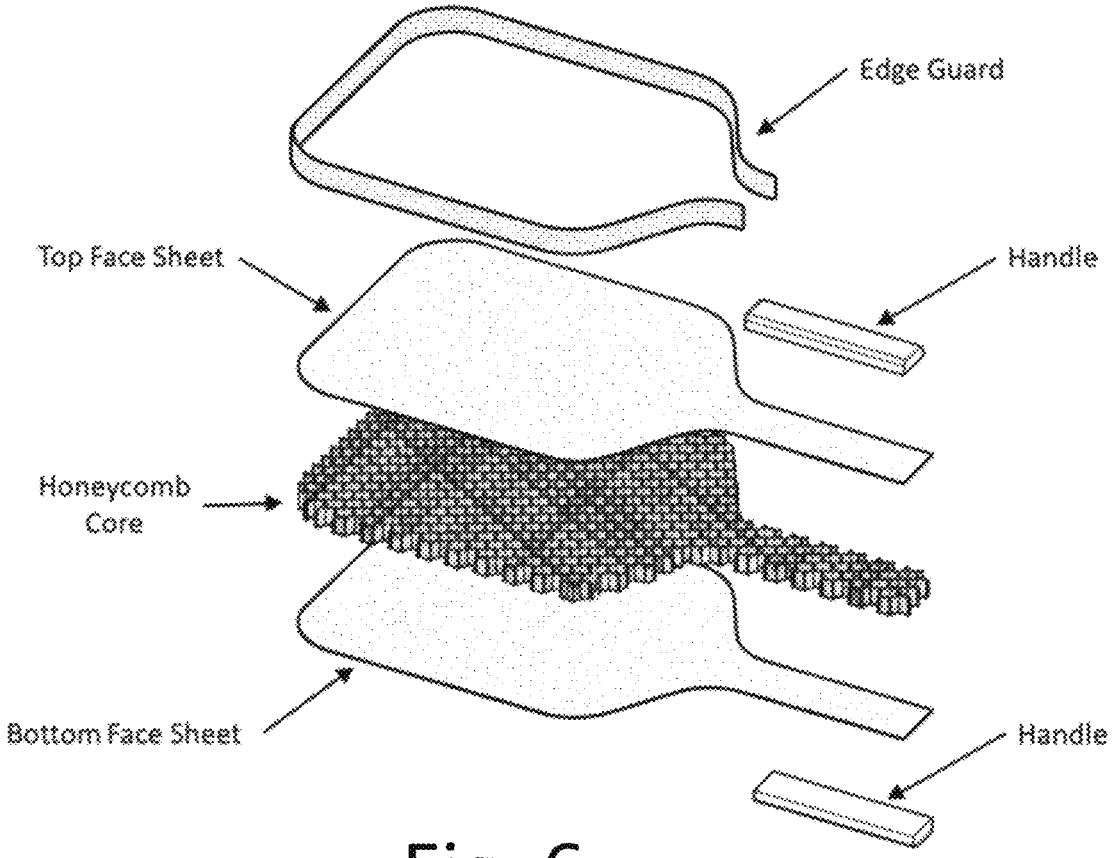
FIG. 6 is a depiction of an exploded view of a paddle which attaches to the apparatus at the handle of the paddle.

In the systems and methods herein, more particularly, the apparatus comprises the base (1A and 2A; 1B and 2B; 3A and 3B; or 4A and 4B) operatively connected to the stem (3A, 3B, 3C, or 3D) operatively connected to the curved body (4A, 4B, 4C, or 4D); and the end-point (5A, 5B, 5C, or 5D). The apparatus is either contacting or attaching to the handle of, for example, a paddle (see FIG. 6). The cannister (10) can be a covering that is readily removable, wherein the covering can be fitted entirely around the base (1A and 2A; 1B and 2B; 3A and 3B; or 4A and 4B), while: covering a substantial portion (i.e., 40-100%) of the vertical section (v) extending from the second half (2A, 2B, 2C, or 2D), and contacting the handle of the paddle (see FIG. 10).

In the system and methods herein, there is no suctioning or telescoping mechanism emanating from the face of the paddle or handle of the paddle to retrieve, for example, a pickleball. The removability of the apparatus and the canister (10) from the handle of the paddle does not impact the handle or grip of the paddle. The apparatus can be facilely appended to the handle of the paddle and the user can hold the paddle from the face or paddle, without having to exert too much energy by bending knees or engaging in strenuous activity. Further, the apparatus appended handle can be facilely removed by merely applying tension against the apparatus to actuate detachment of the apparatus from the handle. In this example, the base (1A and 2A) is spherical which is ¾ inches (") in diameter; the height of the vertical section (v) of the stem (3A) is ½"; the horizontal section (h) of the stem (3A) is ⅛"; the curved body (4A) is ¾"; the end-point (5A), which is rounded, has a length of ½", where i is the angle between the curved body (4A) and end-point (5A), wherein i is 30, 35, 40, 45, 50, or 55 degrees. In a preferred embodiment, i=45 degrees, where the hook of the apparatus has a scythe shape for retrieval of a pickleball, while minimizing bending of the user of the apparatus. For example, the scythe shape of the hook of the apparatus attached or appended to the handle of the paddle can fit into a perforation of the pickleball to make a secured connection. Said secured connection between the hook of the apparatus and the pickleball is not permanent, while being sufficiently stable, such that a lifting motion of the handle does not disturb said secured connection.

Figure 1:
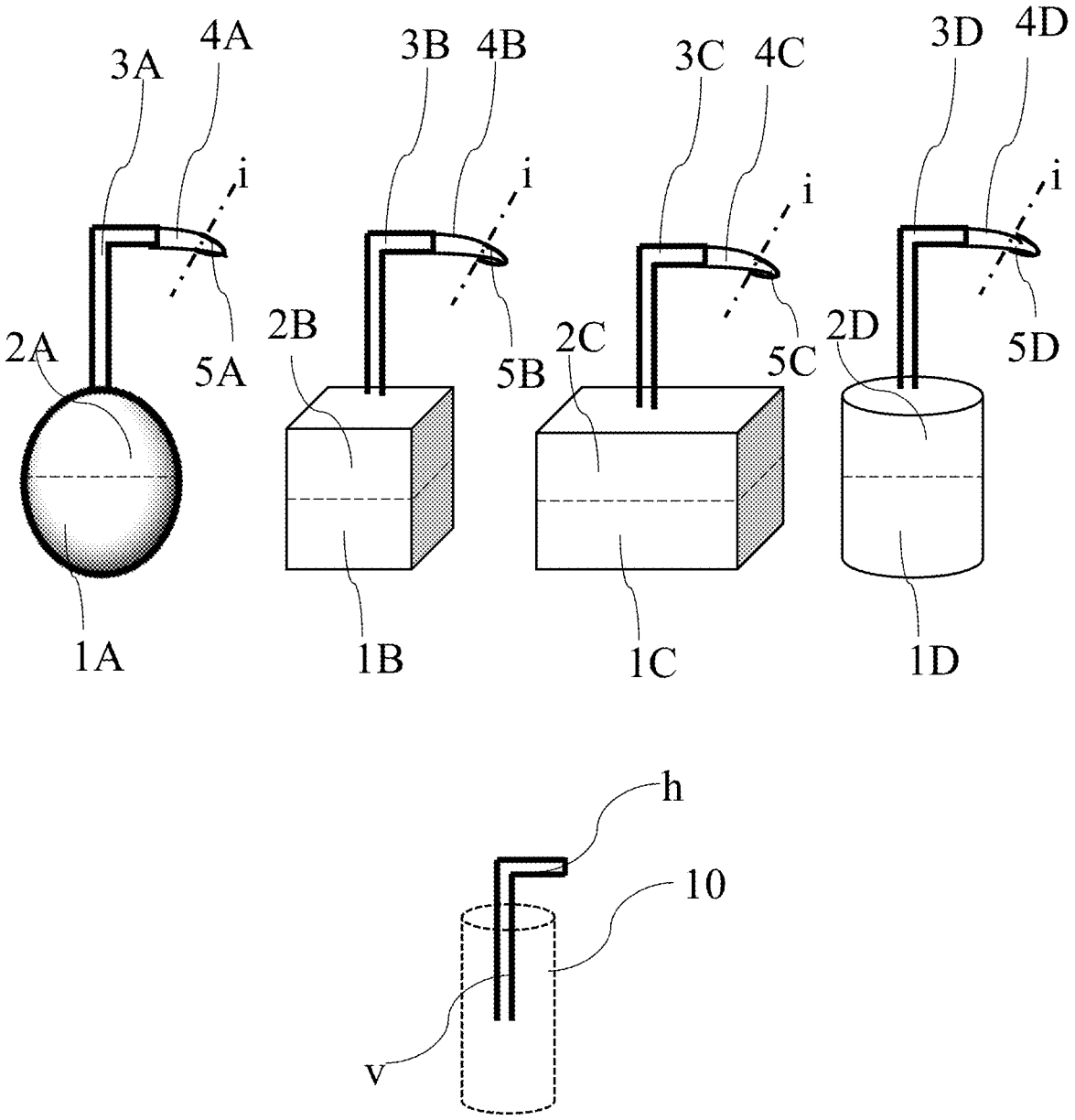
FIG. 1 is a depiction of an apparatus that attaches to a handle of a paddle, wherein the apparatus has a filled base.

In the systems and methods herein, the base, which has a first half and a second half, as denoted by the dotted line, can be a sphere (1A and 2A), a cube (1B and 2B), a rectangular prism (1C and 2C), or a cylinder (1C and 2D). The base can be hollow or filled, wherein the filled base is composed of rubber or cork; and the hollow base has a perimeter composed of plastic, metal, or tear-resistant cardboard. The vertical portion of the stem (3A, 3B, 3C, and 3D) can: (i) pierce through, for example, the rubber or cork of the base to make a secure fit, such that the base, when inverted and attached to the handle, does not disassemble when the pickle ball is retrieved; or (ii) attach onto the surface of the base with an adhesive or fastener mechanism, such that the base, when inverted and attached to the handle, does not disassemble when the pickle ball is retrieved. When the canister (10) is placed around the apparatus in FIG. 1, the second half (1A, 1B, 1C, or 1D) contacts the handle. After retrieval of the pickleball on the hook (the stem (3A, 3B, 3C, or 3D) operatively connected to the curved body (4A, 4B, 4C, or 4D); and the end-point (5A, 5B, 5C, or 5D)), tension against the canister (10), which can be a flexible covering, actuates detachment of the apparatus from the handle of the paddle. In FIG. 1, the diameter of the spherical base (1A and 2A) attached to the hook (rounded-base hook); the width of the cubic base (1B and 2B) or rectangular prism (1C and 2C) attached to the hook (block-base hook); and the diameter of the cylindrical base (1D and 2D) attached to the hook (rounded-base hook) are substantially similar to the diameter/width of the handle of the paddle.

Figure 2:
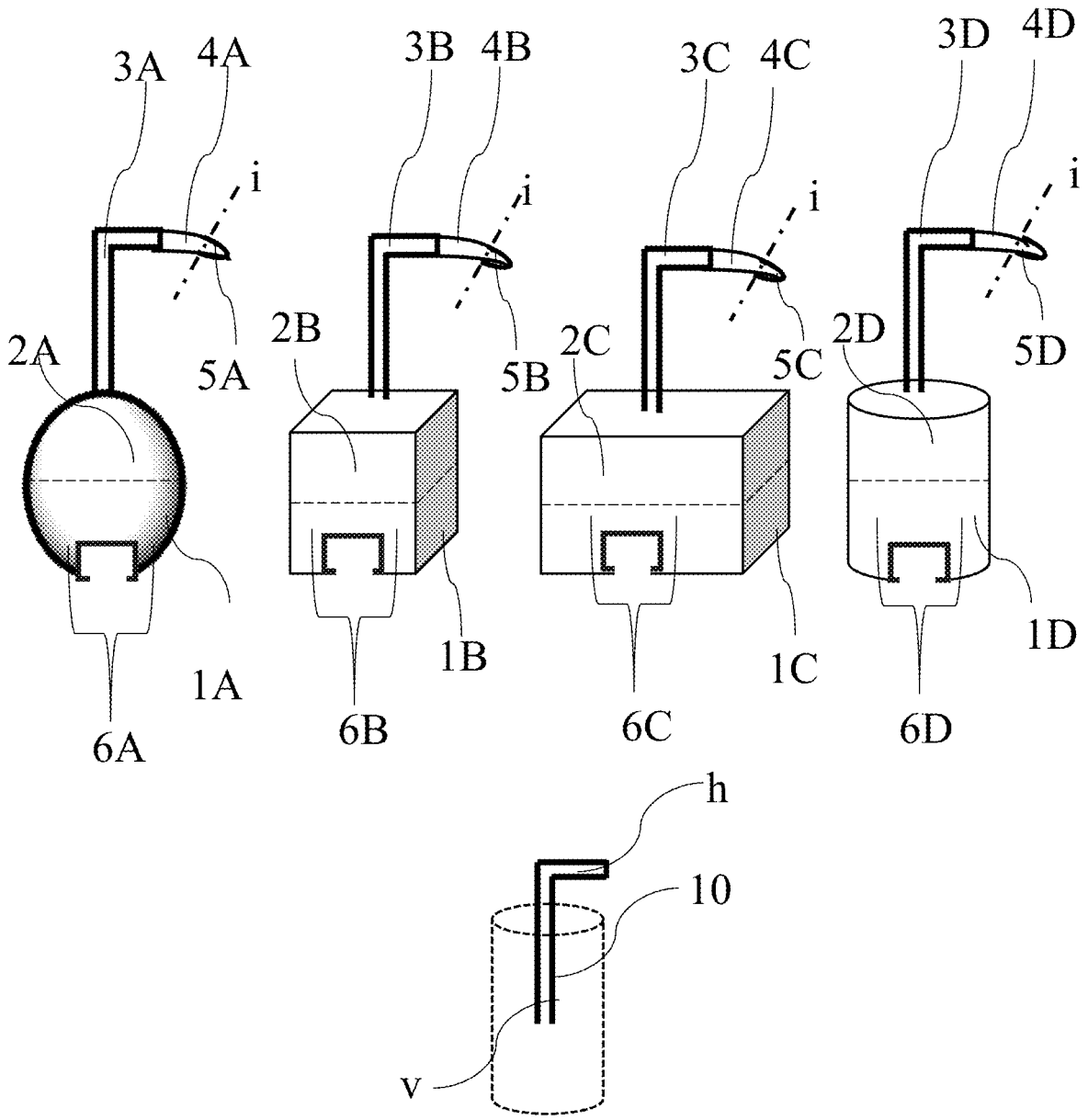
FIG. 2 is a depiction of an apparatus that attaches to a handle of a paddle, wherein the apparatus has an affixed channel with a ledge.

In the systems and methods herein, the base, which has a first half and a second half, as denoted by the dotted line, can be a sphere (1A and 2A), a cube (1B and 2B), a rectangular prism (1C and 2C), or a cylinder (1C and 2D). The base can be hollow or filled, wherein the filled base is composed of rubber or cork; and the hollow base has a perimeter composed of plastic, metal, or tear-resistant cardboard. The vertical portion of the stem (3A, 3B, 3C, and 3D) can: (i) pierce through, for example, the rubber or cork of the base to make a secure fit, such that the base, when inverted and attached to the handle, does not disassemble when the pickle ball is retrieved; or (ii) attach onto the surface of the base with an adhesive or fastener mechanism, such that the base, when inverted and attached to the handle, does not disassemble when the pickle ball is retrieved. When the cannister (10) is placed around the apparatus in FIG. 2, the second half (1A, 1B, 1C, or 1D) contacts the handle. After retrieval of the pickleball on the hook (the stem (3A, 3B, 3C, or 3D) operatively connected to the curved body (4A, 4B, 4C, or 4D); and the end-point (5A, 5B, 5C, or 5D)), tension against the cannister (10), which can be a flexible covering, actuates detachment of the apparatus from the handle of the paddle. In FIG. 2, the diameter of the spherical base (1A and 2A) attached to the hook (rounded-base hook); the width of the cubic base (1B and 2B) or rectangular prism (1C and 2C) attached to the hook (block-base hook); and the diameter of the cylindrical base (1D and 2D) attached to the hook (rounded-base hook) are larger than the diameter/width of the handle of the paddle; where sections of the second half of the base (1A, 1B, 1C, or 1D) are removed to make an affixed channel with ledges (6A, 6B, 6C, or 6D). The ledges of the affixed channel are tabs that can actuate a snapping mechanism, wherein the affixed channel is: (i) resistant to spreading when tension is applied against the walls of the affixed channel; and (ii) configured to fit around the handle of the paddle. The snapping mechanism can be detached when tension is applied against, for example, the base of the apparatus.

Figure 3:
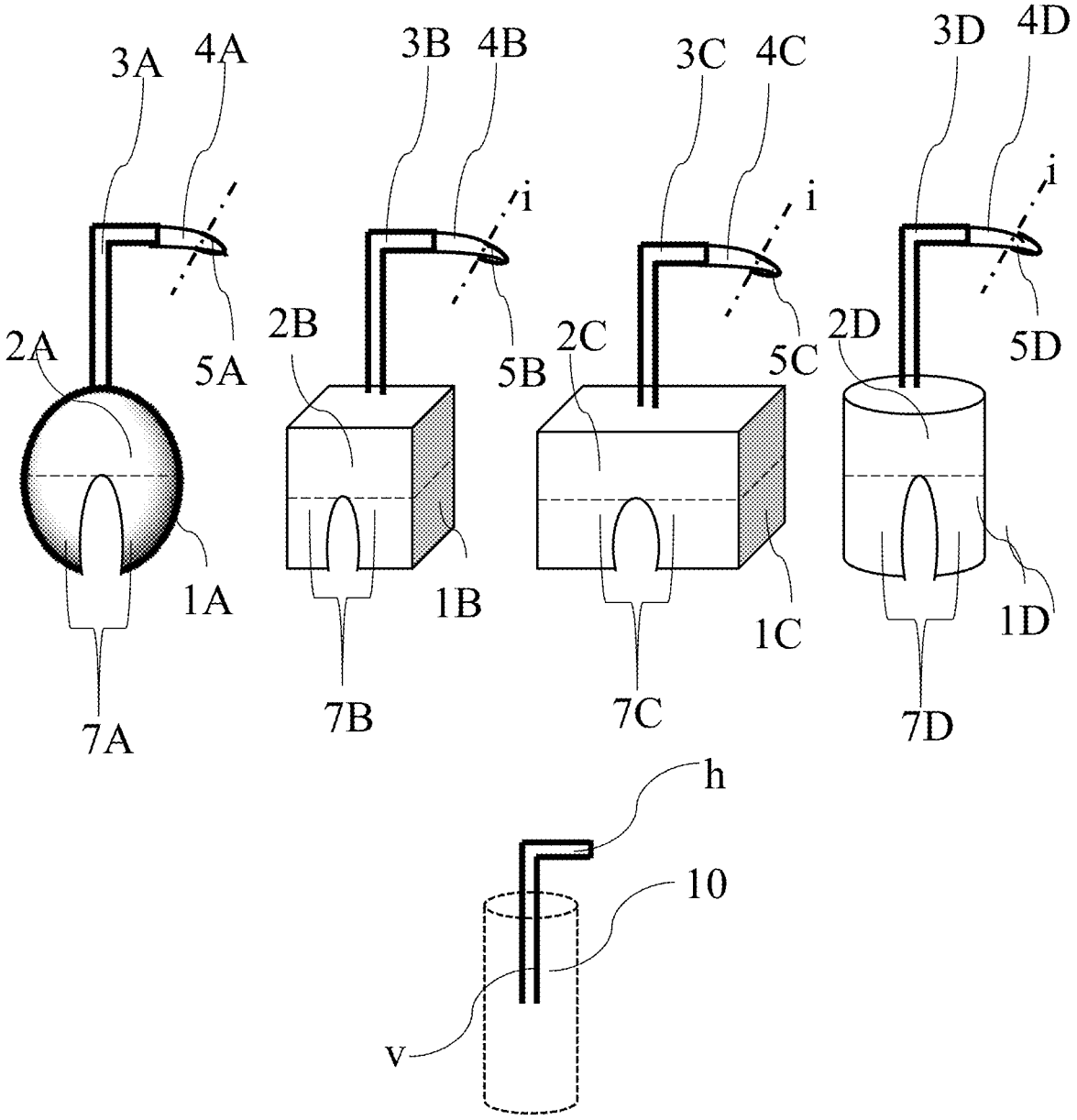
FIG. 3 is a depiction of an apparatus that attaches to a handle of a paddle, wherein the apparatus has a breathable slit.

In the systems and methods herein, the base, which has a first half and a second half, as denoted by the dotted line, can be a sphere (1A and 2A), a cube (1B and 2B), a rectangular prism (1C and 2C), or a cylinder (1C and 2D). The base can be hollow or filled, wherein the filled base is composed of rubber or cork; and the hollow base has a perimeter composed of plastic, metal, or tear-resistant cardboard. The vertical portion of the stem (3A, 3B, 3C, and 3D) can pierce through rubber or cork to make a secure fit, such that the base, when inverted and attached to the handle, does not disassemble when the pickle ball is retrieved. The vertical portion of the stem (3A, 3B, 3C, and 3D) can: (i) pierce through, for example, the rubber or cork of the base to make a secure fit, such that the base, when inverted and attached to the handle, does not disassemble when the pickle ball is retrieved; or (ii) attach onto the surface of the base with an adhesive or fastener mechanism, such that the base, when inverted and attached to the handle, does not disassemble when the pickle ball is retrieved. When the cannister (10) is placed around the apparatus in FIG. 3, the second half (1A, 1B, 1C, or 1D) contacts the handle. After retrieval of the pickleball on the hook (the stem (3A, 3B, 3C, or 3D) operatively connected to the curved body (4A, 4B, 4C, or 4D); and the end-point (5A, 5B, 5C, or 5D)), tension against the cannister (10), which can be a flexible covering, actuates detachment of the apparatus from the handle of the paddle. In FIG. 3, the diameter of the spherical base (1A and 2A) attached to the hook (rounded-base hook); the width of the cubic base (1B and 2B) or rectangular prism (1C and 2C) attached to the hook (block-base hook); and the diameter of the cylindrical base (1D and 2D) attached to the hook (rounded-base hook) are larger than the diameter/width of the handle of the paddle; where sections of the second half of the base (1A, 1B, 1C, or 1D) are removed to make a breathable slit (7A, 7B, 7C, or 7D). The breathable slit extends to the dotted line mark in the base, wherein the breathable slit is: (i) prone to spreading when tension is applied against the walls of the breathable slit; and (ii) configured to fit around the handle of the paddle. The breathable slit can be detached when tension is applied against, for example, the base of the apparatus.

Figure 4:
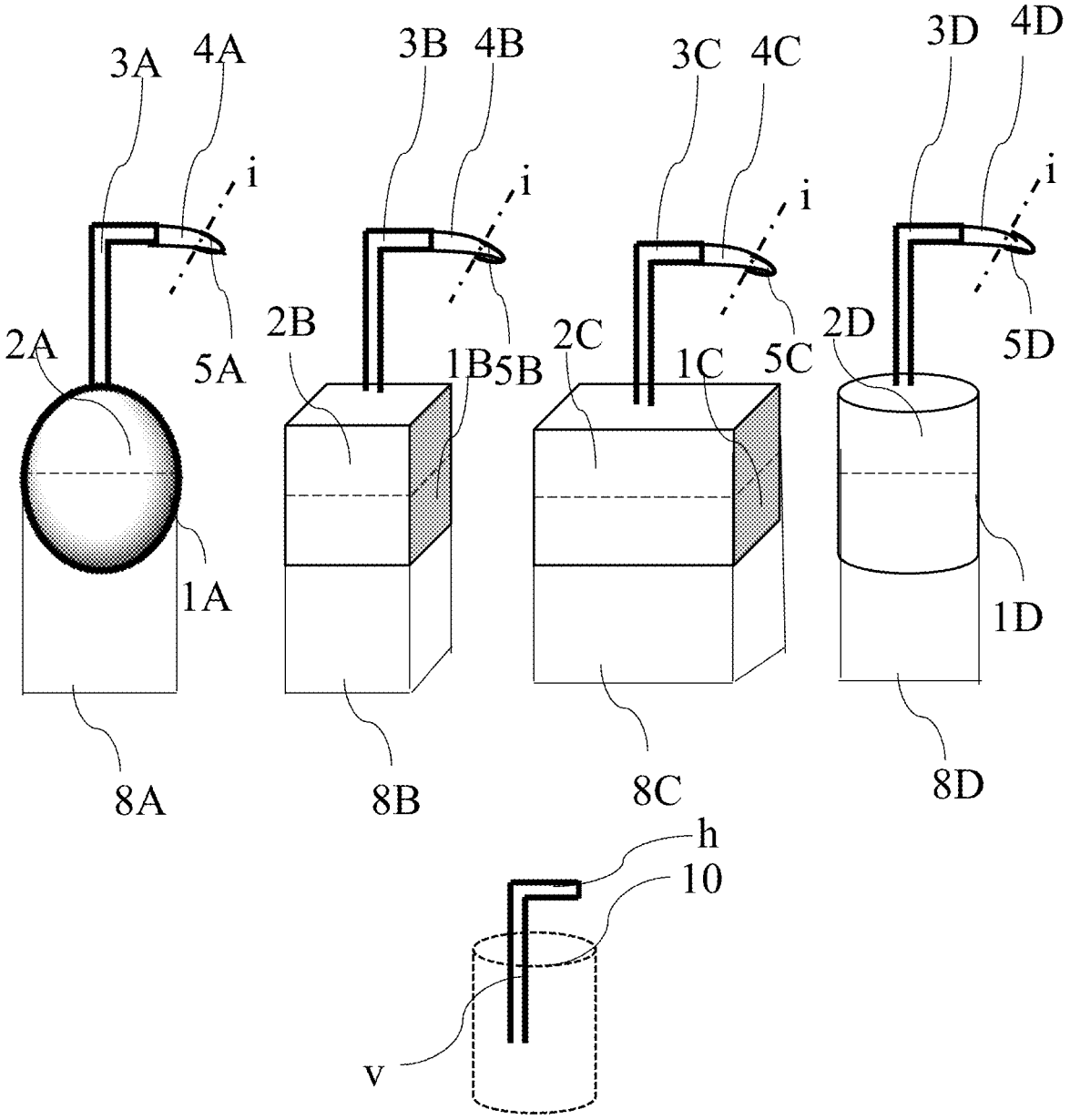
FIG. 4 is a depiction of an apparatus that attaches to a handle of a paddle, wherein the apparatus has a sleeve emanating therefrom.

In the systems and methods herein, the base, which has a first half and a second half as denoted by the dotted line, can be a sphere (1A and 2A), a cube (1B and 2B), a rectangular prism (1C and 2C), or a cylinder (1C and 2D). The base can be hollow or filled, wherein the filled base is composed of rubber or cork; and the hollow base has a perimeter composed of plastic, metal, or tear-resistant cardboard. The vertical portion of the stem (3A, 3B, 3C, and 3D) can pierce through rubber or cork to make a secure fit, such that the base, when inverted and attached to the handle, does not disassemble when the pickle ball is retrieved. The vertical portion of the stem (3A, 3B, 3C, and 3D) can: (i) pierce through, for example, the rubber or cork of the base to make a secure fit, such that the base, when inverted and attached to the handle, does not disassemble when the pickle ball is retrieved; or (ii) attach onto the surface of the base with an adhesive or fastener mechanism, such that the base, when inverted and attached to the handle, does not disassemble when the pickle ball is retrieved. When the cannister (10) is placed around the apparatus in FIG. 4, the second half (1A, 1B, 1C, or 1D) contacts the handle. After retrieval of the pickleball on the hook (the stem (3A, 3B, 3C, or 3D) operatively connected to the curved body (4A, 4B, 4C, or 4D); and the end-point (5A, 5B, 5C, or 5D)), tension against the cannister (10), which can be a flexible covering, actuates detachment of the apparatus from the handle of the paddle. In FIG. 4, the diameter of the spherical base (1A and 2A) attached to the hook (rounded-base hook); the width of the cubic base (1B and 2B) or rectangular prism (1C and 2C) attached to the hook (block-base hook); and the diameter of the cylindrical base (1D and 2D) attached to the hook (rounded-base hook) are substantially similar to the diameter/width of the handle of the paddle. Sleeves (8A, 8B, 8C, and 8D) are attached the second half of the base (1A, 1B, 1C, or 1D). The sleeves, which can be composed of flexible material, extend to the dotted line mark in the base, wherein the sleeve is configured to fit around the handle of the paddle without wobbly points of connection or dangling movements. The sleeve can be detached when tension is applied against, for example, the base of the apparatus.

Figure 5:
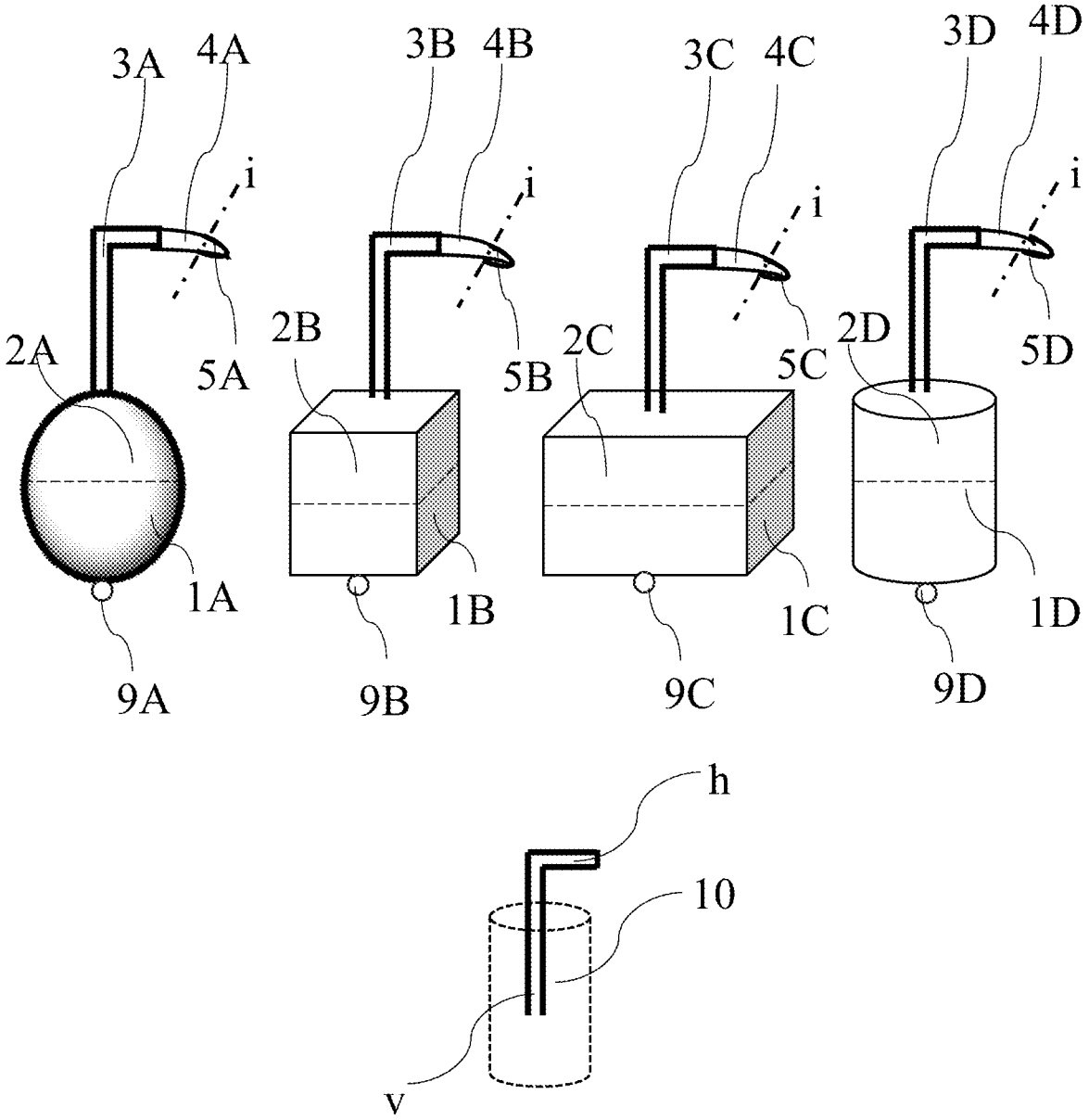
FIG. 5 is a depiction of an apparatus that is attached to a handle of a paddle, wherein the apparatus has an adhesive attached thereto.

In the systems and methods herein, the base, which has a first half and a second half as denoted by the dotted line, can be a sphere (1A and 2A), a cube (1B and 2B), a rectangular prism (1C and 2C), or a cylinder (1C and 2D). The base can be hollow or filled, wherein the filled base is composed of rubber or cork. The vertical portion of the stem (3A, 3B, 3C, and 3D) can pierce through rubber or cork to make a secure fit, such that the base, when inverted and attached to the handle, does not disassemble when the pickle ball is retrieved. The vertical portion of the stem (3A, 3B, 3C, and 3D) can: (i) pierce through, for example, the rubber or cork of the base to make a secure fit, such that the base, when inverted and attached to the handle, does not disassemble when the pickle ball is retrieved; or (ii) attach onto the surface of the base with an adhesive or fastener mechanism, such that the base, when inverted and attached to the handle, does not disassemble when the pickle ball is retrieved. When the cannister (10) is placed around the apparatus in FIG. 5, the second half (1A, 1B, 1C, or 1D) contacts the handle. After retrieval of the pickleball on the hook (the stem (3A, 3B, 3C, or 3D) operatively connected to the curved body (4A, 4B, 4C, or 4D); and the end-point (5A, 5B, 5C, or 5D)), tension against the cannister (10), which can be a flexible covering, actuates detachment of the apparatus from the handle of the paddle. In FIG. 5, the diameter of the spherical base (1A and 2A) attached to the hook (rounded-base hook); the width of the cubic base (1B and 2B) or rectangular prism (1C and 2C) attached to the hook (block-base hook); and the diameter of the cylindrical base (1D and 2D) attached to the hook (rounded-base hook) are substantially similar to the diameter/width of the handle of the paddle. Adhesive pads (9A, 9B, 9C, and 9D) are attached the second half of the base (1A, 1B, 1C, or 1D). The adhesive pads, which is a non-permanent adhesive, are configured to attach to the handle of the paddle. The adhesive pads can be detached when tension is applied against, for example, the base of the apparatus, without damaging the handle to which the adhesive pad was attached.

What is claimed is:

1. An apparatus for retrieving items, comprising:
- a hook; and
- a base with a hollow interior or filled interior, wherein the base comprises:
  - a first half and a second half,
  - wherein the first half is operatively connected to the hook, and
  - wherein the second half is operatively connected to a handle of a paddle;
  - wherein the hook comprises:
    - a stem;
    - a curved body; and
    - an end-point;
      - wherein the stem that has an L-shape when the body is attached to the handle of the paddle and the paddle is held in a fully upright position; and
      - wherein the curved body is operatively connected to the stem and the end-point, wherein the end-point is operatively connected to the stem such that there is at least 30 degrees of separation between a horizontal plane of the stem and a plane of the end point;
  - wherein the second half comprises:
    - an affixed channel spanning a partial section within the second half, wherein the affixed channel is configured to connect the body to the handle, via a snapping mechanism;
    - a breathable slit spanning an entire section across the second half, wherein the breathable slit is configured to connect the body to the handle;
    - an adhesive attached to a top surface of the base, wherein the adhesive is configured to connect the body to the handle via an adhesive mechanism; or
    - a sleeve fitting over the handle, wherein the sleeve is configured to connect the body to the handle.

2. The apparatus of claim 1, wherein the item is a pickle ball, wiffle ball, floorball ball, or a badminton shuttlecock.

3. The apparatus of claim 1, wherein the base is shaped as a sphere, cube, rectangular prism, or cylinder.

4. The apparatus of claim 1, wherein the first half and the second half are equal in area when the adhesive is attached to the top surface of the base.

5. The apparatus of claim 1, wherein the first half has a greater area than the second half when the affixed channel spanning the partial section within the bottom half and the breathable slit spanning the entire section across the bottom half.

6. The apparatus of claim 1, wherein the affixed channel has diameter wider than the handle.

7. The apparatus of claim 6, wherein the affixed channel comprises walls and ledges, wherein the ledges protrude out from the walls.

8. The apparatus of claim 7, wherein the ledges actuate the snapping mechanism when the ledge contacts the handle of the paddle.

9. The apparatus of claim 1, wherein the base is composed of rubber or cork when the base is the filled interior.

10. The apparatus of claim 1, wherein the stem does not dangle when the base is held in the fully upright position.

11. The apparatus of claim 1, wherein the stem has two sections attached perpendicularly to each other to make the L-shape, wherein a first section of the two sections is surrounded by a canister that is wider in diameter than a second section of the two sections.

12. The apparatus of claim 11, wherein the first section of the stem is attached to the base.

13. The apparatus of claim 11, wherein the second section of the stem is attached to the curved body.

14. A method for retrieving a pickleball, wherein the method comprise: Appending an apparatus to a handle of the pickleball paddle, wherein the apparatus comprises:

a hook;

a base with a hollow interior or filled interior, wherein the base comprises:

a first half and a second half, wherein the first half is operatively connected to the hook, and wherein the second half is operatively connected to the handle of the paddle;

wherein the hook comprises: a stem; a curved body; and an end-point;

wherein the stem that has an L-shape when the body is attached to the handle of the paddle and the paddle is held in a fully upright position, and wherein the curved body is operatively connected to the stem and the end-point, wherein the end-point is operatively connected to the stem such that there is 45 degrees of separation between a horizontal plane of the stem and a plane of the end point;

wherein the second half comprises an adhesive attached to a top surface of the base, wherein the adhesive is configured to connect the body to the handle via an adhesive mechanism.

15. A paddle comprising:

a handle operatively connected a face, wherein the face comprises an edge guard;

an apparatus configured for attachment and detachment to the handle; and a canister configured to surround the apparatus, wherein the apparatus comprises:

a hook configured to retrieve a pickleball; and a base with a hollow interior or filled interior, wherein the base comprises: a first half and a second half;

wherein the first half and the second half are equal in area;

wherein the first half is operatively connected to the hook, wherein the second half is operatively connected to the handle of the paddle;

wherein the hook comprises: a stem, a curved body, and an end-point;

wherein the stem that has an L-shape when the body is attached to the handle of the paddle and the paddle is held in a fully upright position, wherein the L-shape of the stem has two sections perpendicularly connected to each other, wherein a first section of the two sections is surrounded by a canister that is wider in diameter than a second section of the two sections, wherein the curved body is operatively connected to the stem and the end-point, wherein the end-point is operatively connected to the stem such that there is 45 degrees of separation between a horizontal plane of the stem and a plane of the end point;

wherein the second half comprises an adhesive attached to a top surface of the base, wherein the adhesive is configured to connect the body to the handle via an adhesive mechanism;

wherein the first section of the L-shape of the stem is attached to the base;

wherein the second section of the L-shape of the stem is attached to the curved body.

* * * * *